US006753819B1

(12) United States Patent
Deinert et al.

(10) Patent No.: US 6,753,819 B1
(45) Date of Patent: Jun. 22, 2004

(54) MOBILE RADIO TRANSMITTING/ RECEIVING DEVICE COMPRISING A TUNABLE-ANTENNA

(75) Inventors: Alfred Deinert, Bocholt (DE); Matthias Lungwitz, Bocholt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/070,866

(22) PCT Filed: Sep. 6, 2000

(86) PCT No.: PCT/DE00/03077

§ 371 (c)(1),
(2), (4) Date: Mar. 11, 2002

(87) PCT Pub. No.: WO01/18907

PCT Pub. Date: Mar. 15, 2001

(30) Foreign Application Priority Data

Sep. 9, 1999 (DE) ..... 199 43 118

(51) Int. Cl.[7] ..... H01Q 1/38; H01Q 1/00

(52) U.S. Cl. ..... 343/702; 340/825.72

(58) Field of Search ..... 343/767, 746, 343/750, 850, 702, 845, 900, 745; 340/825.72; 346/734

(56) References Cited

U.S. PATENT DOCUMENTS 4,490,727 A * 12/1984 Kowols ..... 343/895
6,268,833 B1 * 7/2001 Tanizaki et al. ..... 343/766

* cited by examiner

*Primary Examiner*—James Clinger
(74) *Attorney, Agent, or Firm*—Bell Boyd & Lloyd LLC

(57) ABSTRACT

A mobile radio transmitting and receiving device with a tunable antenna wherein, in order to provide a transmission/reception capability in different frequency bands, with a virtually constant, stable antenna gain, with the radio transmitting and receiving device, a dielectric body which is mounted such that it can be moved is guided by adjusting part, which are controlled by a control device, in a near area of an antenna body, such that the extent of an overlap of the two bodies in the near area of the antenna body is changed until at least one physical input variable, which represents the reception and transmission quality, reaches an optimum.

10 Claims, 2 Drawing Sheets

MOBILE RADIO TRANSMITTING/ RECEIVING DEVICE COMPRISING A TUNABLE-ANTENNA

BACKGROUND OF THE INVENTION

In radio communications systems, messages (for example, voice, picture information or other data) are transmitted via electromagnetic waves. The electromagnetic waves are transmitted via antennas, with the carrier frequencies being in the frequency band intended for the respective system.

In addition to the requirement to restrict the dimensions of the antenna for mobile radio transmitting and receiving devices, there is also an increasing requirement for the capability to transmit and receive in different frequency bands. For this reason, antennas are required which can be used in a number of frequency bands.

When using conventional antennas (for example, rod antennas as are used, in particular, in mobile parts) the required coverage of a frequency band which is as wide as possible, or of a number of frequency bands, cannot be ensured since the impedance and antenna gain of the antenna vary severely as a function of the frequency. As such, it is impossible to use the antenna in certain frequency ranges.

Thus, in order to solve this problem, antenna systems have been used which include a number of antennas, each of which covers a specific frequency range.

Antenna systems such as these have the disadvantages that they require more space and, moreover, the matching of the antennas to the individual frequencies from the respective frequency band is less than optimum.

An object to which the present invention is directed to design a mobile radio transmitting and receiving device such that, while covering a wide frequency range, it ensures a virtually constant, stable antenna gain.

SUMMARY OF THE INVENTION

Accordingly, the mobile radio transmitting and receiving device of the present invention has an electrically effective antenna body, in whose near field a dielectric body is mounted such that it can move. As such, the dielectric body can be moved in the near field of the antenna body such that the extent to which the dielectric body and the electrically effective antenna body overlap in the near field is varied. The resonant frequency which can be set, in this case, becomes lower the greater the extent of the overlap in the near field of the antenna body. In order to make it possible to adjust the extent of the overlap, it is possible to adjust the position of the dielectric body. The position is varied on the basis of at least one control signal, which is produced as an output signal by a control device and is passed to an adjusting part of the device. The control signal is produced by the control device until the extent of the overlap ensures an optimum value of at least one physical variable, which represents a function of the transmission/reception quality of the radio transmitting and receiving device, and which is detected by a detection part and is passed as an input signal to the control device.

The major advantage of the mobile radio transmitting and received device according to the present invention is that the antenna gain is largely stable over a wide frequency range, which is achieved by regulating the variable or variables which represents or represent the reception quality as an optimum value by moving the dielectric body in the near area of the antenna body. In this case, the extent of the overlap of the antenna body and of the dielectric body leaves the polar diagram of the antenna virtually unchanged, thus ensuring good matching over the frequency range. Furthermore, the arrangement has the advantage that the antenna (the antenna body) need not be moved, which is advantageous to the design of the mobile radio transmitting and receiving device, and the external electrical influence is minimized.

A major advantage of one embodiment of the present invention is that any directional electrical influence on the antenna by the user, in particular by his/her head, on the radio transmitting and receiving device is minimized, and vice versa.

Pursuant to another embodiment of the present invention, it is possible to minimize non-directional external influences simultaneously, since they have a greater effect the greater the electrically effective antenna length of an antenna. At the same time, the connection for the radio-frequency signal is applied through the slot which runs parallel to the longitudinal axis, so that the dielectric hollow body can move without impediment and without changing the length of the supply line for the radio-frequency signal.

An advantage of yet another embodiment of the present the invention is the provision of a simple device for adjusting the position of the dielectric body, which requires only one control signal.

Another embodiment of the present invention includes the provision of a simple adjusting part for the position of the dielectric body, which require only one control signal, with the adjustment process being carried out in defined steps (step angles).

Major advantages of another embodiment of the present invention are the flexibility and updating capability for implementation of the control process, which is facilitated by the use of (control) software, and the capability to use already existing processors for controlling the mobile radio transmitting and receiving device according to the present invention by the use of additional software, or by the adaptation of existing software.

In another embodiment of the present invention, advantages are found in the simple and advantageous implementation of the control unit, and the capability to implement this switching mechanism, as an integrated circuit in an expansion module.

An advantage of yet another embodiment lies in the high dielectric constant of ceramic, since the frequency range in which the antenna can be tuned, and thus can be used, increases in proportion to the magnitude of the dielectric constant of the hollow body that is used, and the purchasing costs are low, since ceramic bodies are produced in large numbers; for example, as bodies for resonators.

An advantage of a further embodiment of the present invention is that it is possible to use the mobile radio transmitting and receiving device in a frequency range within which the ratio of the highest to lowest frequency is at least 1.5 octaves.

The detection of the forward transmission power and backward transmission power in another embodiment as a physical variable which represents a function of the transmission/reception quality of the radio transmitting and receiving device allows simple implementation of the control (matching) for the antenna, since parts which already exist in the radio transmitting and receiving device can be used for this purpose.

Additional features and advantages of the present invention are described in, and will be apparent from, the following Detailed Description of the invention and the Figures.

DETAILED DESCRIPTION OF THE INVENTION

Figure 1:
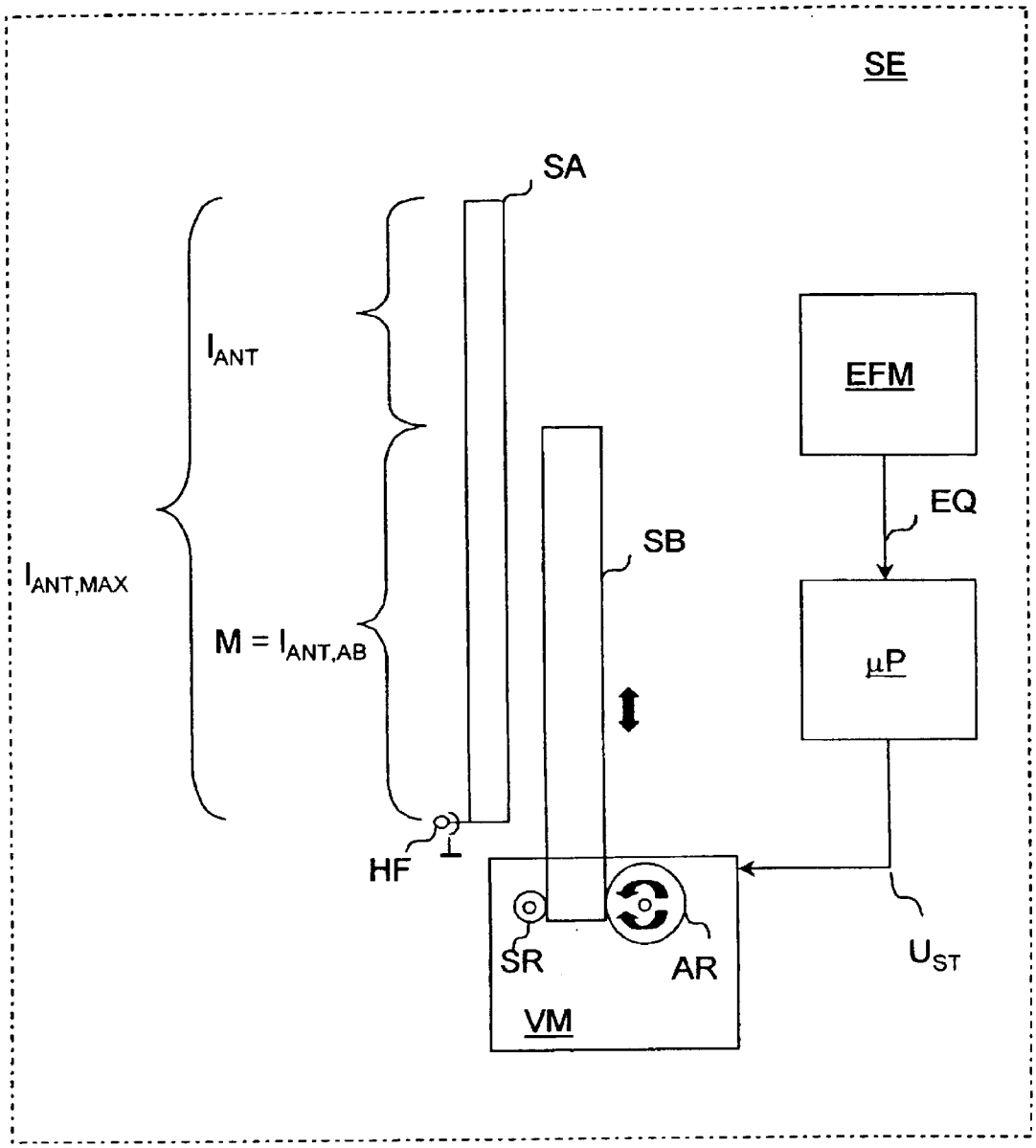
FIG. 1 shows a mobile radio transmitting and receiving device with a rod antenna, which is enclosed by a dielectric body in the form of a slotted hollow cylinder (illustrated in section form), in which case the dielectric body can be extended and retracted via a controlled electric motor.

FIG. 1 shows a mobile radio transmitting and receiving device SE with a transmitting/receiving antenna in the form of a rod antenna SA, in which case the maximum effective antenna length $l_{max}$ for radio purposes is governed by the length of the rod antenna SA.

A dielectric body in the form of a rod SB is arranged parallel to the longitudinal axis of the rod antenna SA. The distance of the rod should not be excessively large in comparison to the wavelength, since the different phase delay times which would otherwise occur would result in a different polar diagram characteristic than that which is normal for rod antennas (monopole antennas).

Alternatively, the dielectric body may have other desired geometric shapes. The only essential feature is that, when the dielectric body is introduced into the near field of the antenna, the antenna is tuned such that it is tuned to the current frequency.

The way in which the choice of the geometric shape is made depends in, particular, on the antenna and may, for example, be determined by simulation or by trial installations.

The frequency range that is covered is increased by increasing the volume and increasing the dielectric constant of the dielectric body that is used.

Thus, the dielectric body can be manufactured, for example, from ceramic, since ceramic may have a dielectric constant of 88.

The dielectric rod SB is mounted such that it can move in such a way that it can be extended and retracted by a drive wheel AR which is rotated forward or backward by an electric motor VM which, for example, is in the form of a stepping motor. In this case, the drive roller AR makes contact with it on one side, and a support wheel SR makes contact with it on the side of the rod SB opposite the point of contact (for support) so that the rotary movement of the drive wheel AR is converted to a linear movement of the rod SB, thus defining an extent M by which the rod antenna SA and the dielectric rod SB overlap.

The (stepping) angle and the rotation direction are governed by the magnitude, the mathematical sign and/or the duration of a voltage (control signal) $U_{ST}$ which is applied to the electric motor VM.

This voltage $U_{ST}$ is a signal (control signal) which is produced at the output of a control unit (microprocessor) $\mu$P, and whose magnitude, mathematical sign and/or signal duration are/is dependent on an input variable EQ which is applied to the control unit $\mu$P.

The control unit $\mu$P controls the electric motor VM via the signal $U_{ST}$ until a physical input variable EQ, which represents the reception quality of the radio transmitting and receiving device, has reached an ideal value (optimum).

In this case, the electric motor VM is first of all driven such that it always rotates the drive roller AR in a predetermined direction (default) at the start of the control process. If the evaluation shows that the input variable EQ is moving away from the ideal value, the rotation direction is changed and the electric motor VM is driven until the input variable EQ has reached the ideal value.

Alternatively, it is also possible to start the control process from a defined start point, such as with the dielectric rod SB always being in the completely extended state (that is to say, the extent of the overlap M or a length $l_{ANT,AB}$ which is covered by the rod SB is equal to the maximum electrically effective antenna link $l_{ANT,MAX}$) and, thus, to set this start point reliably, initially, at the start of the control process. This procedure is necessary, in particular, when using the mobile radio transmitting and receiving device SE over a very wide frequency range, in which the ratio of the highest frequency to the lowest frequency is at least 1.5 octaves since, otherwise, it would be possible for a situation to occur in which an electrically effective antenna length $l_{ANT}$, which results from the difference between the maximum electrically effective antenna length $l_{ANT,MAX}$ and the antenna length $l_{ANT,AB}$ which is covered by the dielectric rod SB, has a magnitude corresponding to three quarters of that wavelength which results from the current frequency, so that the control process is ended, since the input variable EQ likewise reaches the ideal value in this situation. Since an object of the present invention is not achieved in this situation, this value of the antenna length $l_{ANT}$ is not desired. It is possible to prevent the process of controlling the antenna length $l_{ANT}$ from ending on reaching this value if, for example, suitable control software is used to start the process of controlling the antenna length $l_{ANT}$ at a minimum effective antenna length for radio purposes, which is obtained when the dielectric rod SB is fully extended, thus ensuring that the input variable EQ always guarantees optimum matching of the antenna when it reaches the ideal value.

The (possibly preprocessed) input variable EQ is passed to the control unit $\mu$P from detection part EFM for detecting physical input variables EQ which are dependent on the extent of the overlap M, and which may be transformed by the detection part EFM to a form that is required for the control unit $\mu$P.

Alternatively, the detective part EFM also detects a number of physical input variables EQ and may preprocess them, before passing them to the control unit $\mu$P, in which case the control unit $\mu$P checks, in a corresponding manner, whether a number of input variables have reached an ideal value.

Figure 2:
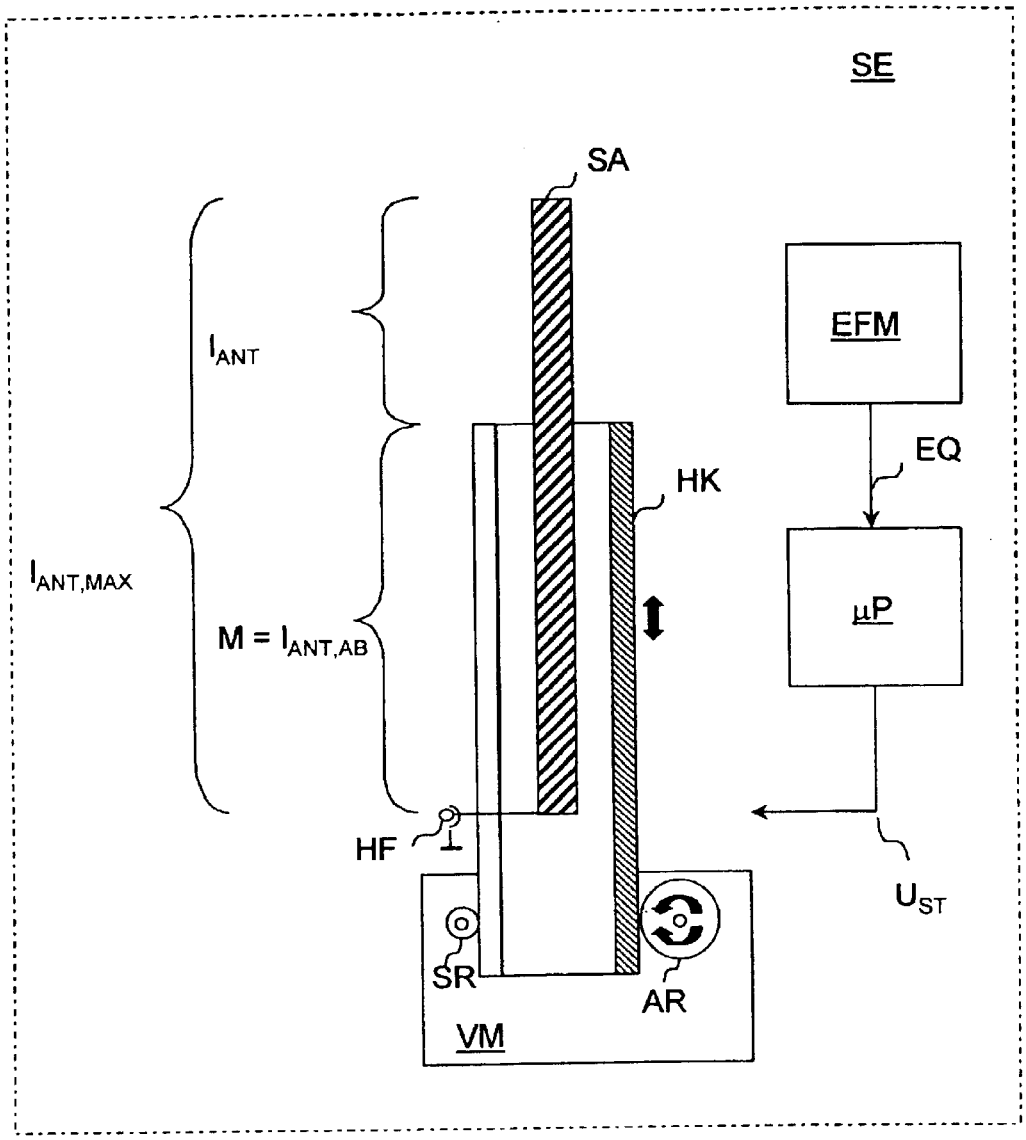
FIG. 2 shows a mobile radio transmitting and receiving device with a rod antenna, in which a dielectric body in the form of a rod is arranged parallel to the antenna, in which case the dielectric body can be extended and retracted using a controlled electric motor.

FIG. 2 shows a mobile radio transmitting and receiving device SE with a transmitting/receiving antenna in the form of a rod antenna SE, in which case a maximum effective antenna length $l_{MAX}$ for radio purposes is determined by the length of the rod antenna SA.

A dielectric body in the form of a hollow body is arranged symmetrically with respect to the longitudinal axis of the rod antenna SA such that the longitudinal axis of the rod antenna SA coincides with the longitudinal axis of the dielectric hollow body HK. The diameter of the hollow body HK should be chosen such that the side walls of the hollow body are not excessively far away, with respect to the wavelength, since the different phase delay times which would otherwise occur would result in a polar diagram other than the normal polar diagram for rod antennas (monopole antennas).

In order to allow a radio-frequency signal to be passed to the rod antenna SA, a slot is provided parallel to the longitudinal axis of the rod antenna SA, through which the radio-frequency connection HF is passed such that the hollow body can be extended completely without any impediment (that is, covering the entire rod antenna) and can be retracted completely without any impediment (that is, exposing the entire rod antenna).

Alternatively, the hollow body HK also can be designed without a slot, but the radio-frequency connection HF must then be routed through the lower opening of the hollow body HK, in which case the radio-frequency connection HF and, in particular, its supply line may need to be matched when the position of the dielectric hollow body HK is changed.

The dielectric hollow body HK is mounted such that it can move in such a way that it can be extended and retracted by a drive wheel AR which is rotated forward or backward by an electric motor VM which is, for example, in the form of a stepping motor. In this case, the drive roller AR makes contact with it on one side, and the support wheel SR makes contact with it on the side of the hollow body HK opposite the point of contact (for support) so that the rotary movement of the drive wheel AR is converted to a linear movement of the hollow body HK, thus defining an extent M by which the hollow body HK and the rod antenna SA overlap.

The (stepping) angle and the rotation direction are governed by the magnitude, the mathematical sign and/or the duration of a voltage (control signal) $U_{ST}$ which is applied to the electric motor VM.

This voltage $U_{ST}$ is a signal (control signal) which is produced at the output of a control unit (microprocessor) $\mu$P, and whose magnitude, mathematical sign and/or signal duration are/is dependent on the input variable EQ applied to the control unit $\mu$P.

The input variable EQ is determined by a detection part that is provided.

The detection part EFM may be designed such that it has a directional coupler RK, which outputs a forward transmission power and a backward transmission power from a transmission signal (this configuration of the detection part also can be used with the embodiment of the present invention described in FIG. 1).

The forward transmission power is then first of all rectified by a first rectifier, and the rectified forward transmission power is then converted by a first analog/digital converter to a first digital signal. The backward transmission power is rectified by a second rectifier, and the rectified backward transmission power is then converted by a second analog/digital converter to a second digital signal.

The digital signals are applied as an input signal to the control unit $\mu$P, with the control unit $\mu$P being, for example, in the form of a (micro)processor with associated software. When the digital signals are applied, the processor $\mu$P checks whether any of the signals have reached an ideal value; i.e., no backward transmission power or minimum backward transmission power and maximum forward transmission power.

When this is the case, no control signal $U_{ST}$ is produced, since there is no need to change the extent of the overlap.

If this is not the case, the processor $\mu$P first of all produces a first control signal $U_{ST}$, so that the adjusting device VM retracts the hollow body, or extends it, in particular starting from the default value. The input signals (forward and backward transmission power) which are applied to the processor, and which are changed by this process, are checked by the processor to determine whether they have reached the ideal values. If the values of the signals (forward and backward transmission power) are worse with regard to reaching the ideal values, then the rotation direction of the part VM for adjusting the position of the dielectric hollow body HK is changed. This is done, for example, by reversing the mathematical sign of the signal $U_{ST}$.

The signal $U_{ST}$ is produced following the determination of the correction direction until the forward and backward transmission powers have reached their ideal values.

Alternatively, only one of the two variables (forward transmission power or backward transmission power $P_R$) may be used as the controlled variable for this control loop, that is to say can be detected by the detection part EFM, with the processor $\mu$P checking whether it has reached the ideal value; i.e., minimum or no backward transmission power or maximum forward transmission power.

As an alternative to the use of an additional processor $\mu$P, it also would be feasible to upgrade already existing processors via suitable control software in order to allow this control process to be carried out.

When using an additional processor $\mu$P, it also would be feasible to integrate the detection part EFM in the processor $\mu$P.

The exemplary embodiments which have been mentioned represent only some of the embodiments that are possible pursuant to the present invention. Thus, a person who is skilled in the art and is active in this field will be able to create a large number of further embodiments by advantageous modifications without departing from the character (essence) of the present invention; i.e., matching of an antenna by moving a dielectric body in the near field of the antenna. These embodiments also are, likewise, intended to be covered by the present invention as set forth in the hereafter amended claims.

What is claimed is:

1. A mobile radio transmitting and receiving device, comprising:

an electrically effective antenna body;

a dielectric body mounted in a near field of the electrically effective antenna body such that the dielectric body can move, and whereupon an extent to which the dielectric body and the electrically effective antenna body overlap in the near field is changed;

an adjusting part for adjusting a position of the dielectric body;

a detection part for detecting at least one physical variable which represents a function of transmission and reception quality of the radio transmitting and receiving device; and a control device connected to the detection part for controlling the adjusting part, via at least one control signal as a function of the at least one physical variable, until the extent of the overlap ensures an optimum value for the at least one physical variable which represents a function of the transmission and reception quality of the radio transmitting and receiving device.

2. A mobile radio transmitting and receiving device as claimed in claim 1, wherein the electrically effective antenna body is a rod antenna, the dielectric body is a hollow body with a slot which runs parallel to a longitudinal axis of the hollow body, and the dielectric body can move along a longitudinal axis of the rod antenna such that the extent of the overlap depends on a difference between a maximum electrically active antenna length of the rod antenna and a covered antenna length of the rod antenna which is enclosed by the hollow body.

3. A mobile radio transmitting and receiving device as claimed in claim 1, wherein the electrically effective antenna body is a rod antenna, the dielectric body is a rod, and the dielectric body can move parallel to the rod antenna, on one longitudinal face of the rod antenna, such that the extent of the overlap is governed by a difference between a maximum electrically effective antenna length of the rod antenna and an antenna length, which is covered by the rod on the longitudinal face, of the rod antenna.

4. A mobile radio transmitting and receiving device as claimed in claim 1, wherein the adjusting part includes at least one electric motor.

5. A mobile radio transmitting and receiving device as claimed in claim 4, wherein the electric motor is a stepping motor.

6. A mobile radio transmitting and receiving device as claimed in claim 1, wherein the control device is a processor having software which is designed to produce the at least one control signal.

7. A mobile radio transmitting and receiving device as claimed in claim 1, wherein the control device is a switching mechanism.

8. A mobile radio transmitting and receiving device as claimed in claim 1, wherein the dielectric body is formed from ceramic.

9. A mobile radio transmitting and receiving device as claimed in claim 1, wherein the control device sets the extent of the overlap to a maximum value at a start of the adjustment of the extent of the overlap.

10. A mobile radio transmitting and receiving device as claimed in claim 1, wherein the detection part detects at least one of forward transmission power and backward transmission power of a transmitted signal.

* * * * *